US009593484B2

(12) United States Patent
Knoll et al.

(10) Patent No.: US 9,593,484 B2
(45) **Date of Patent: *Mar. 14, 2017**

(54) FREE-STANDING WALL

(71) Applicant: Target Brands, Inc., Minneapolis, MN (US)

(72) Inventors: Mitchell Knoll, Eagan, MN (US); Timothy J. Martell, Brooklyn Park, MN (US); Daniel R. Jicinsky, Amery, WI (US)

(73) Assignee: Target Brands, Inc., Minneapolis, MN (US)

( * ) Notice: Subject to any disclaimer, the term of this patent is extended or adjusted under 35 U.S.C. 154(b) by 1 day.

This patent is subject to a terminal disclaimer.

(21) Appl. No.: 14/664,864

(22) Filed: Mar. 22, 2015

(65) Prior Publication Data

US 2016/0273213 A1 Sep. 22, 2016
US 2017/0022706 A9 Jan. 26, 2017

Related U.S. Application Data

(63) Continuation of application No. 13/709,615, filed on Dec. 10, 2012, now Pat. No. 9,032,682.

(51) Int. Cl.

| | |
|---|---|
| ***E04B 2/74*** | (2006.01) |
| ***E04C 2/34*** | (2006.01) |
| *E04B 2/00* | (2006.01) |
| *E04B 2/76* | (2006.01) |
| *E04B 2/82* | (2006.01) |

(52) U.S. Cl.
CPC ..... *E04C 2/34* (2013.01); *E04B 2/74* (2013.01); *E04B 2/7422* (2013.01); *E04B 2/00* (2013.01); *E04B 2/76* (2013.01); *E04B 2/82* (2013.01); *E04B 2002/7466* (2013.01); *E04C 2002/3488* (2013.01)

(58) Field of Classification Search
CPC ..... E04C 2/34; E04C 2002/3488; E04B 2/74; E04B 2/7422; E04B 2/76; E04B 2/82; E04B 2/00
USPC ..... 52/238.1, 239, 241, 481.2, 36.5
See application file for complete search history.

(56) References Cited

U.S. PATENT DOCUMENTS 1,915,697 A * 6/1933 Robinson ..... E04B 2/58 52/241
3,065,575 A * 11/1962 Ray ..... E04B 2/58 52/241

(Continued)

FOREIGN PATENT DOCUMENTS

AU CA 2360142 A1 * 4/2003 ..... E04B 2/7425
CH 622848 A5 * 4/1981 ..... E04B 2/7438

*Primary Examiner* — Adriana Figueroa
(74) *Attorney, Agent, or Firm* — Merek, Blackmon & Voorhees, LLC

(57) ABSTRACT

A free-standing wall includes an internal frame, a pair of wall panel assemblies supported on each side of the internal frame by cleats and a top plate. The internal frame includes opposing sides that define a thickness. Each of the pair of wall panel assemblies includes a panel having an interior surface and a width. The top plate includes a width that is at least as great as a combined dimension of the thickness of the internal frame and the widths of each panel. The top plate is coupled to a top of the internal frame to secure the pair of wall panel assemblies to the internal frame.

19 Claims, 8 Drawing Sheets

(56) References Cited

U.S. PATENT DOCUMENTS 3,948,011 A * 4/1976 Price ..... E04B 2/7409 411/466
4,075,810 A * 2/1978 Zakrzewski ..... E02D 27/00 52/169.5
4,128,979 A * 12/1978 Price ..... E04B 2/58 411/466
4,177,968 A * 12/1979 Chapman ..... E04C 3/07 249/211
4,245,448 A * 1/1981 Agar ..... E04B 2/763 52/489.2
4,448,004 A * 5/1984 Thorsell ..... E04B 2/763 52/241
4,693,047 A * 9/1987 Menchetti ..... E04B 2/763 52/241
4,719,730 A * 1/1988 Winkowski ..... E04B 2/7411 52/144
5,060,434 A * 10/1991 Allison ..... E04B 2/7411 52/238.1
5,216,859 A * 6/1993 Moreno ..... E04B 2/7411 52/238.1
5,341,615 A * 8/1994 Hodges ..... E04B 2/7425 52/220.7
5,632,127 A * 5/1997 Agar ..... E04B 2/7453 52/238.1
5,642,593 A * 7/1997 Shieh ..... E04B 2/7424 160/130
5,740,639 A * 4/1998 Covington ..... E06B 9/02 49/463
5,802,789 A * 9/1998 Goodman ..... A47B 83/001 52/238.1
5,809,715 A * 9/1998 Tanaka ..... E04B 2/7416 160/236
5,826,385 A * 10/1998 Dykstra ..... E04B 2/7422 160/135
5,953,876 A * 9/1999 Agar ..... E04B 2/7409 52/481.1
6,173,545 B1 * 1/2001 Feldpausch ..... A47B 57/425 52/239
6,276,102 B1 * 8/2001 Shipman ..... A47B 57/425 52/220.7
6,662,520 B1 * 12/2003 Nelson ..... E04B 1/161 52/474
7,017,310 B2 * 3/2006 Brunt ..... E04B 2/763 174/66
7,051,488 B2 * 5/2006 Nelson ..... E04B 1/161 52/481.1
8,176,695 B2 * 5/2012 Deweerd ..... E04B 2/7425 52/220.7
2002/0088188 A1 * 7/2002 Chang ..... F21V 33/0032 52/238.1
2008/0040997 A1 * 2/2008 Klein ..... E04B 1/24 52/241
2008/0104907 A1 * 5/2008 Glick ..... E04B 2/7425 52/239
2012/0311946 A1 * 12/2012 Liu ..... E04B 2/7425 52/239

* cited by examiner

FREE-STANDING WALL

The subject patent application is a continuation of U.S. patent application Ser. No. 13/709,615 filed on Dec. 10, 2012 from which priority is claimed under 35 USC §120. The entire content of U.S. patent application Ser. No. 13/709,615 is incorporated herein by reference.

BACKGROUND

Free-standing walls are non-permanent partition systems that divide up a workspace into partially enclosed workstations to offer workers a degree of privacy. Still further, free-standing walls are non-permanent partition systems that can also be used to divide up a retail space or spaces in order to designate certain areas as work zones or display zones or to provide obstacles to the flow of customer or worker traffic.

The discussion above is merely provided for general background information and is not intended to be used as an aid in determining the scope of the claimed subject matter.

SUMMARY

A free-standing wall includes a substantially horizontal base frame member, a substantially horizontal top frame member, a pair of substantially vertical end frame members, at least one pair of angle bars, a pair of wall sections and a top plate. The pair of substantially vertical end frame members couple ends of the substantially horizontal base frame member to ends of the substantially horizontal top frame member. The angle bars extend between the pair of substantially vertical frame members at a height and include a top edge. Each of the pair of wall sections includes wedges. The wedges are attached to inner facing surfaces of the wall sections. At least some of the wedges are adapted to engage with the top edges of the angle bars. The top plate is coupled to a top of the substantially horizontal top frame member and has a width that is greater than the widths of each of the substantially horizontal frame members and the substantially vertical frame members.

To alter a work or retail space, the substantially horizontal and vertical frame members are coupled together to form an internal frame having opposing sides that defined a thickness. At least some of the wedges of the wall sections are engaged with the top edges of the angle bars so that one of the wall sections is supported on one of the opposing sides and the other of the wall sections is supported on the other of the opposing sides. Furthermore, the top plate is attached to the top of the horizontal top frame member. The top plate includes a width that at least as great as the combined width of one of the frame members and both of the wall sections. The top plate secures the wedges to the top edges of the angle bars so that the wedges are unable to disengage from the top edges of the angle bars.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a free-standing wall having one or more free-standing wall units for altering a work or retail space. For example, in a retail environment, the free-standing wall can be used to designate certain areas as work zones or display zones or to provide obstacles to the flow of customer or worker traffic. Each free-standing wall unit includes an internal frame, a pair of wall assemblies and a top plate. The pair of wall assemblies each have wall panels that are attached to the internal frame by engaging cleats located on the interior surface of each panel with members of the internal frame. The top plate has a width that is greater than the combined thickness of the panels and the internal frame. In this way, the top plate keeps the wall panel assemblies and cleats secured to members of the internal frame.

Figure 1:
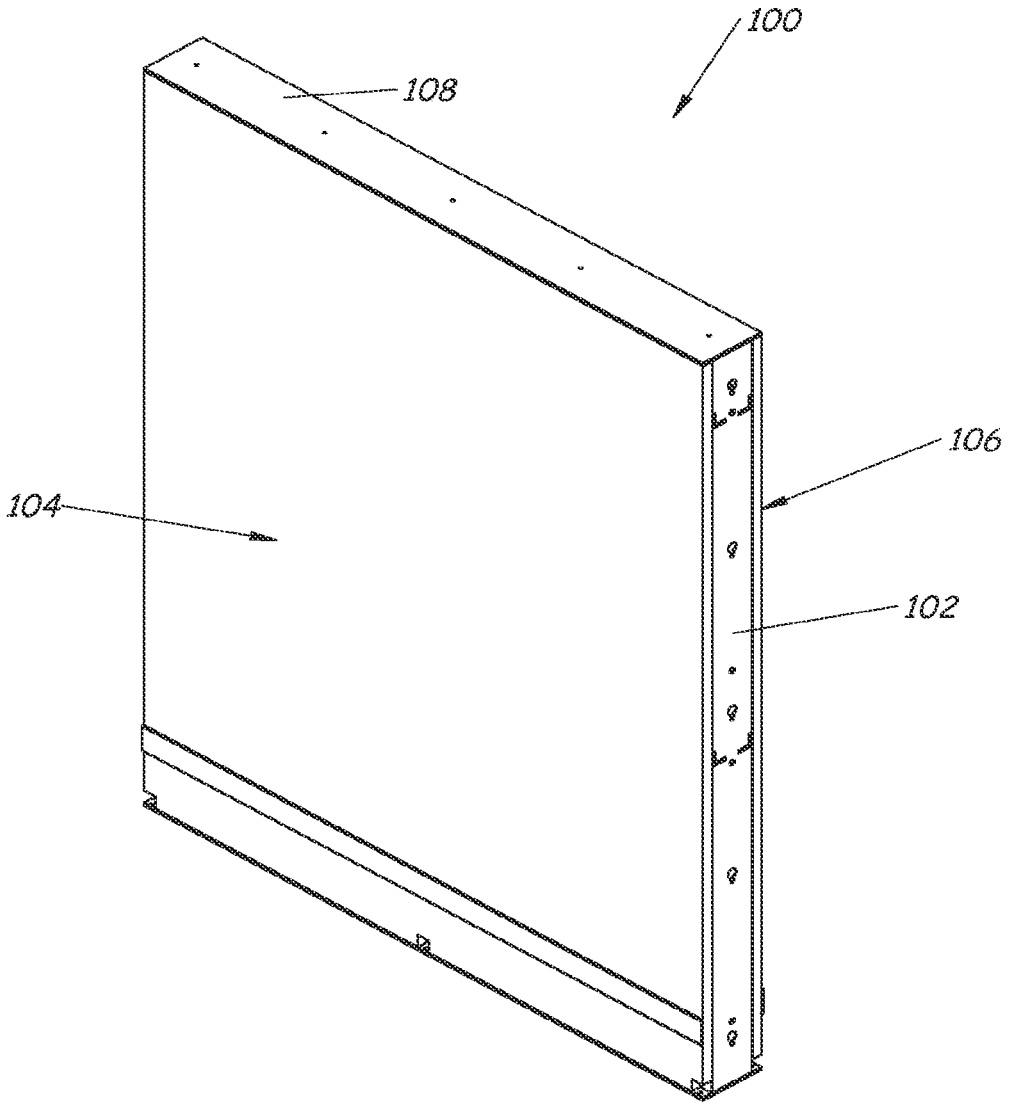
FIG. 1 is a perspective view of a free-standing wall according to an embodiment.
Figure 2:
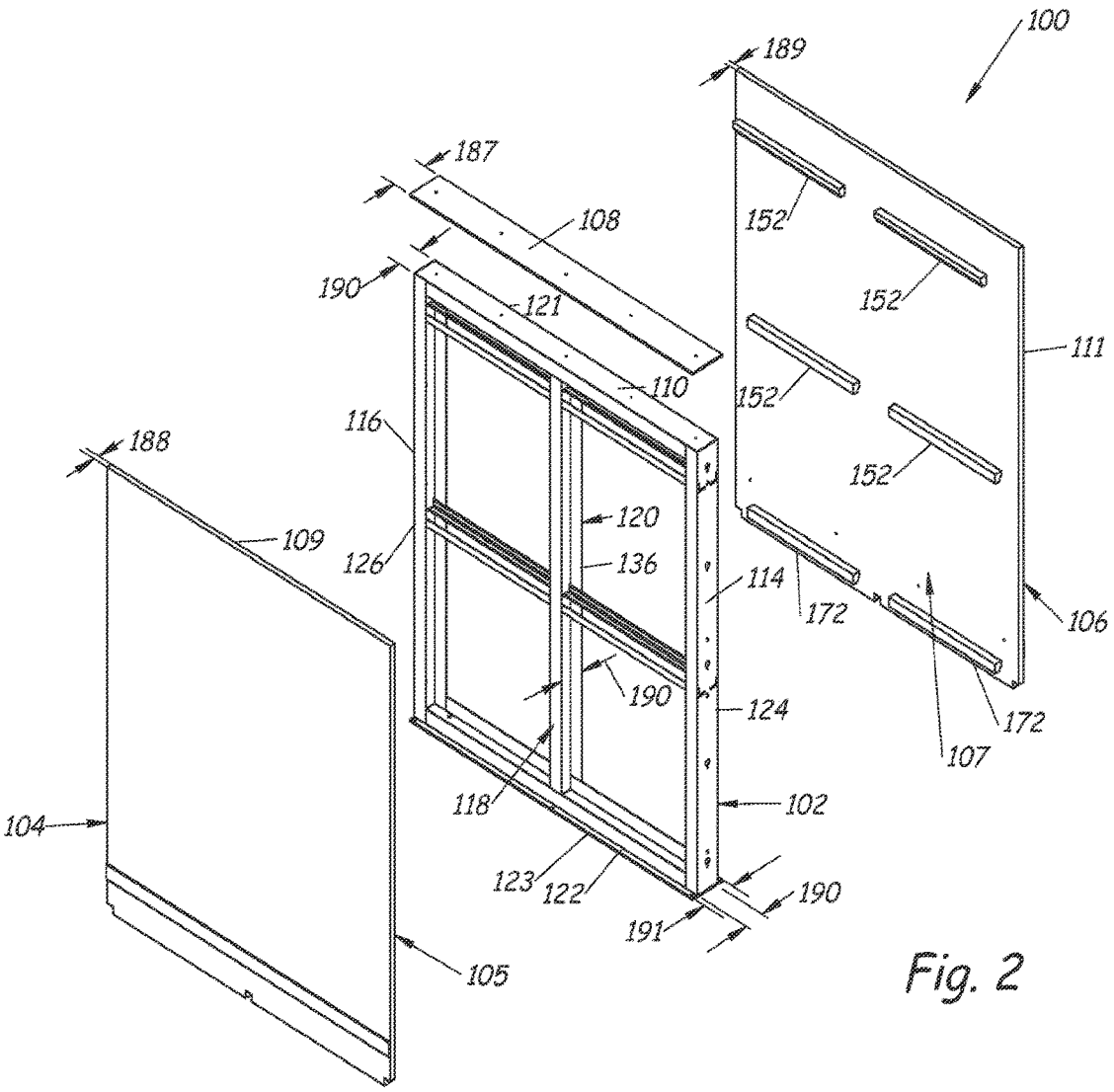
FIG. 2 is an exploded perspective view of the free-standing wall illustrated in FIG. 1.

FIG. 1 illustrates a perspective view of a free-standing wall unit 100 and FIG. 2 illustrates an exploded perspective view of free-standing wall unit 100 according to an embodiment. Free-standing wall unit 100 includes an internal frame 102, a pair of substantially identical wall panel assemblies 104 and 106 and a top plate 108. Internal frame 102 includes a top 110, a bottom 112 and two opposing ends 114 and 116. More specifically, a portion of top 110, bottom 112 and two opposing ends 114 and 116 of internal frame 102 define a front side 118 and a portion of top 110, bottom 112 and two opposing ends 114 and 116 of internal frame 102 define a back side 120. As illustrated, internal frame 102 supports first wall assembly 104 on front side 118 and internal frame 102 supports second wall assembly 106 on hack side 120. First and second wall assemblies 104 and 106 are substantially identical. Therefore, while FIG. 2 illustrates only the exterior of wall panel assembly 104 and illustrates only the interior of wall panel assembly 106, it should be recognized that the exterior of wall panel assembly 106 is substantially identical to the exterior of wall panel assembly 104 and the interior of wall panel assembly 104 is substantially identical to the interior of wall panel assembly 106. Wall panel assembly 104 includes a panel or wall section 109 having interior surface 105 and cleats 152 and 172. Wall panel assembly 106 includes a panel or wall section 111 having interior surface 107 and cleats 152 and 172. Furthermore, cleats 152 and 172 of first wall assembly 104 support first wall panel assembly 104 on front side 118 of internal frame 102 and cleats 152 and 172 of second wall assembly 106 support second wall panel assembly 106 on back side 120 of internal frame 102.

Figure 3:
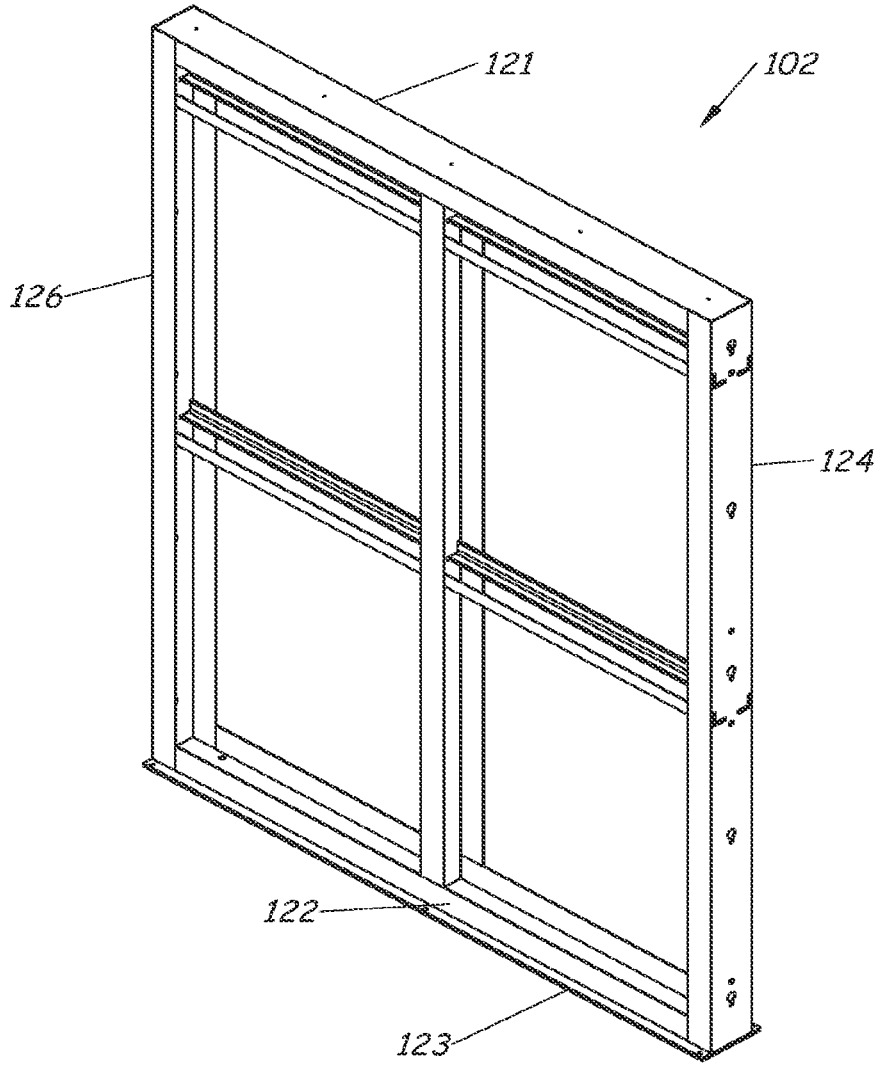
FIG. 3 is a perspective view of a frame of the free-standing wall illustrated in FIG. 1.
Figure 4:
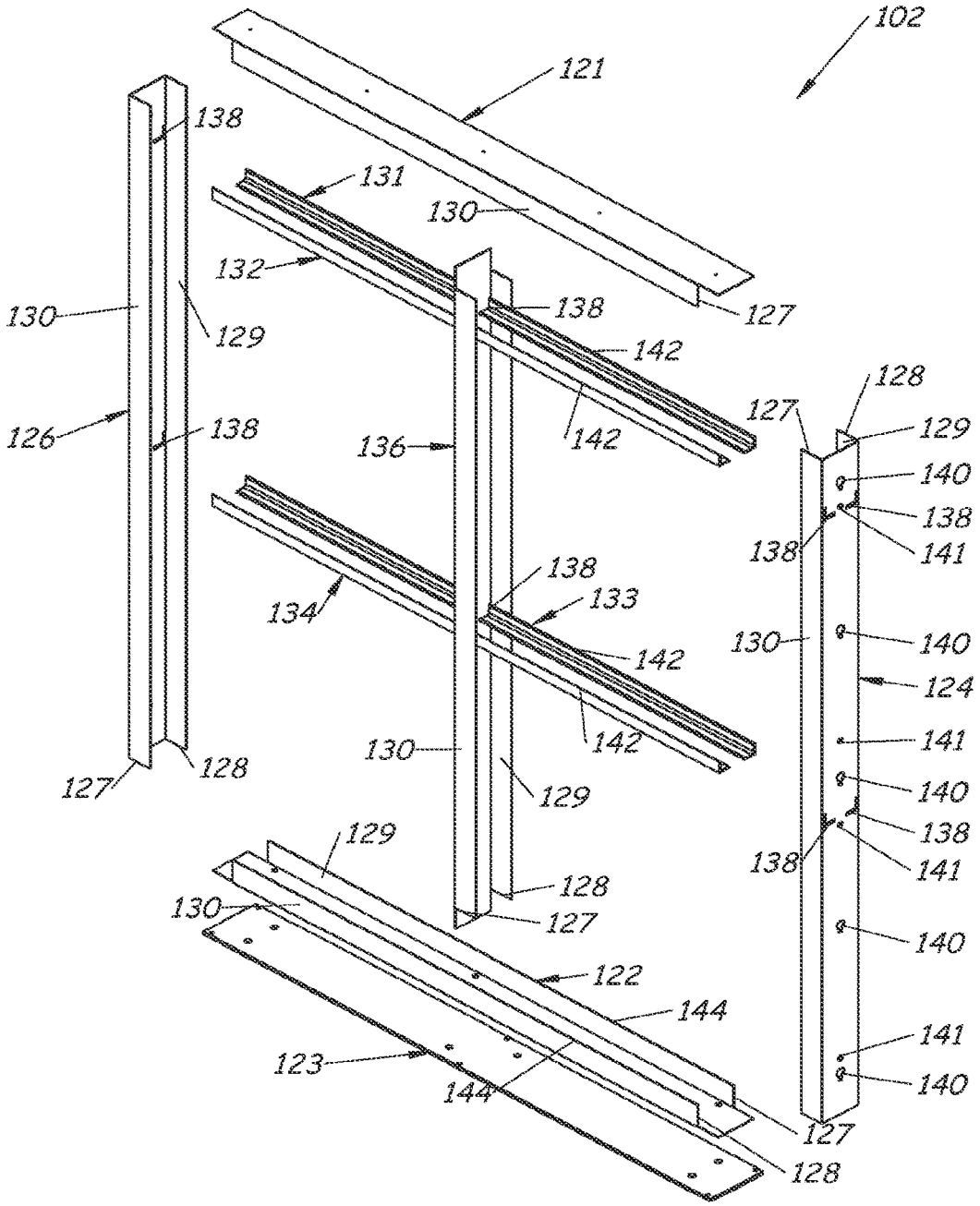
FIG. 4 is an exploded perspective view of the free-standing wall illustrated in FIG. 1.
Figure 5:
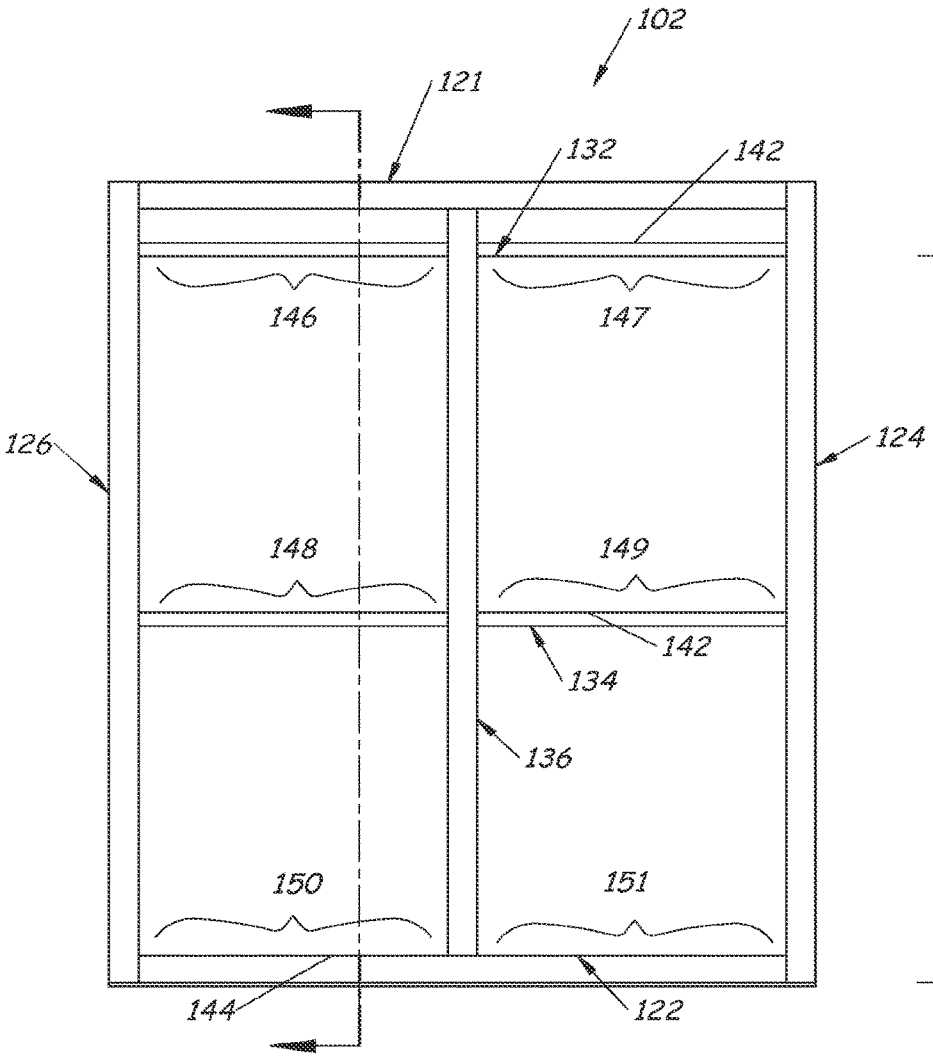
FIG. 5 is a front view of the frame illustrated in FIG. 3.
Figure 6:
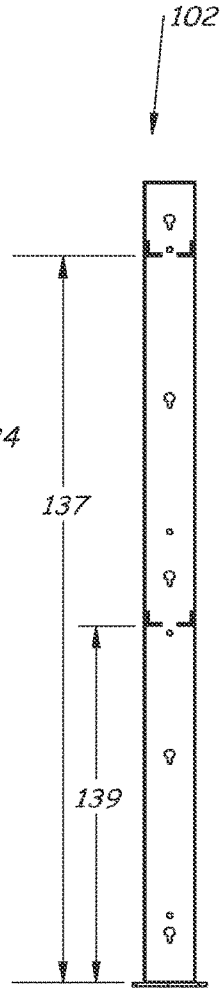
FIG. 6 is a section view of the frame illustrated in FIG. 3 and taken through the section line designated in FIG. 5.

FIG. 3 illustrates a perspective view of internal frame 102, FIG. 4 illustrates an exploded perspective view of internal frame 102. FIG. 5 illustrates a front view of internal frame 102 and FIG. 6 illustrates a section view of internal frame 102 taken along the section line indicated in FIG. 5. Top 110 (FIG. 2) of internal frame 102 is defined by a substantially horizontal top frame member or channel 121, bottom 112 (FIG. 2) of internal frame 102 is defined by a substantially horizontal base frame member or channel 122 and a base plate 123, end 114 (FIG. 2) of internal frame 120 is defined by a substantially vertical end frame member or channel 124 and end 116 is defined by a substantially vertical end frame member or channel 126. Base plate 123 includes holes for receiving anchor bolts for anchoring internal frame 102 to a floor of a work or retail space. The vertical end frame members 124 and 126 couple ends of horizontal base frame member 122 to ends of horizontal top frame member 121. As illustrated, top channel 121 and bottom channel 122 are substantially identical and end channel 124 and end channel 126 are substantially identical. Furthermore, as illustrated more clearly in FIG. 4, each of members 121, 122, 124 and 126 has a substantially U-shaped configuration that includes opposing legs 127 and 128 having inner facing surfaces 129 and outer facing surfaces 130. While members 121 and 122 include the U-shaped configuration as describe, members 121 and 122 include ends that are free of the U-shaped configuration.

Internal frame 102 also includes substantially identical angle bars 131, 132, 133 and 134 and a substantially vertical mid frame member or mid channel 136. Like channels 121, 122, 124 and 126, mid channel 136 also has a substantially U-shaped configuration that includes opposing legs 127 and 128 having inner facing surfaces 129 and outer facing surface 130. Mid channel 136 is similar to end channels 124 and 126 in some ways. For example, end channels 124 and 126 and mid channel 136 all include apertures 138 for receiving angle bars 131, 132, 133 and 134. The shape of apertures 138 corresponds with the shape of angle bars 131, 132, 133 and 134. However, mid channel 136 is dissimilar to end channels 124 and 126 in other ways. For example, end channels 124 and 126 include additional holes 140 and 141 for receiving hardware for coupling free-standing wall unit 100 to other free-standing wall units 100 to form a free-standing wall. While additional apertures 140 and 141 of end channel 124 are illustrated in FIG. 4, the section view illustrated in FIG. 6 illustrates additional aperture 140 and 141 of end channel 126.

When constructing internal frame 102, angle bars 131, 132, 133 and 134 are inserted through apertures 138 in mid channel 136. More specifically, each angle bar 131, 132, 133 and 134 includes two legs that are oriented substantially perpendicular to each other. The two legs of each angle bar 131, 132, 133 and 134 slide within a corresponding aperture 138, which also includes two legs, such that angle bars 131, 132, 133 and 134 are positioned substantially perpendicular to mid channel 136. Angle bars 131 and 132 are located at the substantially same vertical position or height 137 along channels 124, 126 and 136 and face each other. In other words, the legs that are oriented substantially vertical on angle bars 131, 132, 133 and 134 are positioned toward the exterior of internal frame 102 relative to the legs that are oriented substantially horizontal on angle bars 131, 132, 133 and 134. In addition, angle bars 133 and 134 are located at the substantially same vertical position or height 139 along channels 124, 126 and 136 and face each other. Height 139 of angle bars 133 and 134 is different from height 137 of angle bars 131 and 132. More specifically, angle bars 133 and 134 are located below angle bars 131 and 132 or height 139 is less than height 137.

After angle bars 131, 132, 133 and 134 are inserted through apertures 138 in mid channel 136, end channels 124 and 126 are coupled to opposing ends of angle bars 131, 132, 133 and 134 by receiving the ends of angle bars 131, 132, 133 and 134 through apertures 138 in end channels 124 and 126. In this way, angle bars 131 and 132 are located at the substantially same vertical position along end channels 124 and 126 and angle bars 133 and 134 are located at the substantially same vertical position along end channels 124 and 126. However and as noted above, the vertical position of angle bars 131 and 132 are different from the vertical position of angles bars 133 and 134. To complete the construction of internal frame 102 and as illustrated in FIGS. 3 and 5, ends of top and bottom channels 121 and 122 (where bottom channel 122 is attached to base plate 123), which are free of the U-shaped configuration, are coupled to ends of end channels 124 and 126 by way of spot welding or the like to form a rectangle having two upper corners and two lower corners. In this way, the ends of mid channel 136 engage with the U-shaped configuration of channels 121 and 122. Mid channel 136 is evenly spaced apart from end channels 124 and 126.

As illustrated in FIGS. 4 and 5, the substantially vertical oriented leg of angle bars 131, 132, 133 and 134 includes an angle bar top edge 142. In addition, the substantially vertical oriented legs 127 and 128 of bottom channel 122 include top edges 144. Because of the interconnection between angle bars 131, 132, 133 and 134 with vertical end channels 124 and 126 and mid channel 136, edges 142 and 144 are exposed to the exterior of internal frame 104 in sections. These sections are illustrated as upper sections 146 and 147, middle sections 148 and 149 and lower sections 150 and 151.

Figure 7:
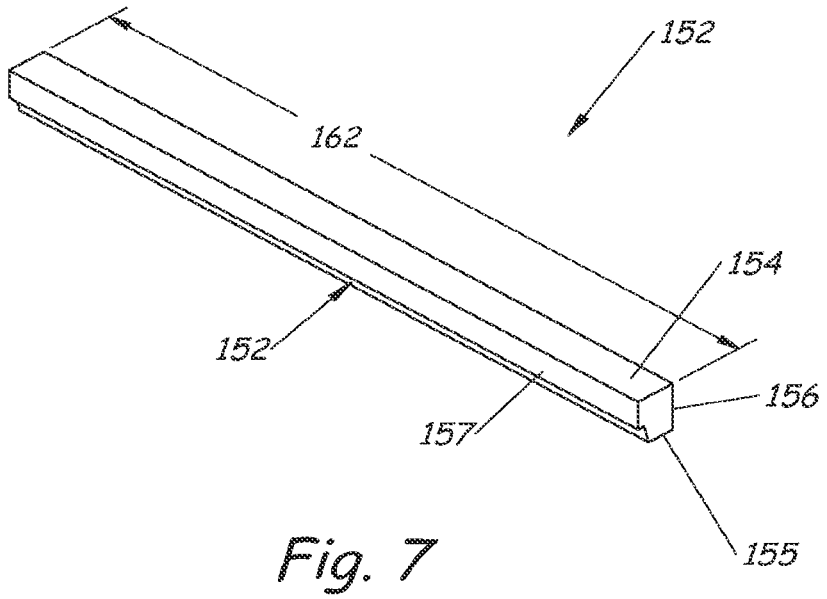
FIG. 7 is a perspective view of a cleat of the free-standing wall illustrated in FIG. 1 according to one embodiment.
Figure 8:
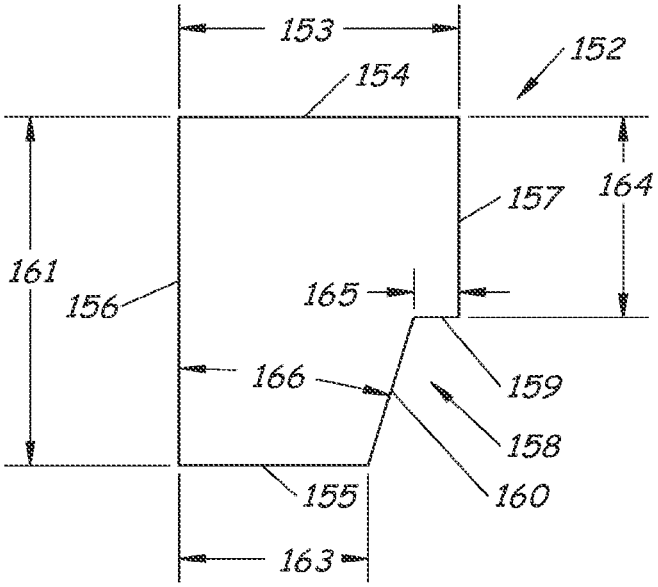
FIG. 8 is a side view of the cleat illustrated in FIG. 7.

FIG. 7 illustrates a perspective view and FIG. 8 illustrates a side view of one of the cleats or wedges 152 of the pair of wall panel assemblies 104 and 106 according to one embodiment. As illustrated in FIG. 2, four cleats 152 are coupled to the interior surfaces or inner facing surfaces 105 and 107 of each wall panel assembly 104 and 106. In particular, the type of cleat 152 illustrated in FIGS. 7 and 8 is located on the interior surface 105 and 107 of each wall panel assembly 104 and 106 at two upper locations and two middle locations. In the upper location, the two cleats 152 are attached to interior surfaces 105 and 107 and are spaced apart from each other. In the middle location, the two cleats 152 are attached to interior surfaces 105 and 107 and are spaced apart from each other.

With reference to FIGS. 7 and 8, cleat 152 includes a top surface 154, a bottom surface 155, a protruding surface 156 and a mounting surface 157. While top surface 1154 spans an entire width 153 of cleat 152 and is substantially parallel with bottom surface 155 and protruding surface 156 spans an entire height 161 of cleat 152 and is substantially parallel with mounting surface 157, cleat 152 does not form an elongated rectangular bar of length 162. Rather, elongated cleat 152 has a length 162 that includes a shoulder 158 that intersects with bottom surface 155 and intersects with mounting surface 157. In this way, bottom surface 155 includes a width that is less than the entire width 153 of cleat 152 and mounting surface 157 includes a height that is less than the entire height 161 of cleat 152. In one embodiment and as illustrated in FIGS. 7 and 8, a width 163 of bottom surface 155 is approximately 68.75% of the entire width 153 of cleat 152. In other words, if the width 153 of cleat 152 is approximately 1 inch, then the width 163 of bottom surface 155 is approximately 11/16 of an inch. In one embodiment and as illustrated in FIGS. 7 and 8, a height 164 of mounting surface 157 is approximately 75% of the entire height 161 of cleat 152. In other words, if the height 161 of cleat 152 is approximately 1.25 inches, then the height 164 of mounting surface 157 is approximately a ½ of an inch.

Shoulder 158 includes an upper surface 159 and an angled surface 160. Upper surface 159 intersects with mounting surface 1157 and is substantially parallel with top surface 154. In one embodiment and as illustrated in FIGS. 7 and 8, a width 165 of upper surface 159 is approximately 18.75% of the entire width 153 of cleat 152. In other words, if the width 153 of cleat 152 is approximately 1 inch, then the width 165 of upper surface 159 is approximately 3/16 of an inch. Angled surface 160 intersects with bottom surface 155 and is oriented at an acute angle 166 from protruding surface 156 and mounting surface 157. In particular, angled surface 160 is oriented at approximately 14 degrees from protruding surface 156 and mounting surface 157. As illustrated in FIG. 2, the mounting surface 157 of each cleat 152 is attached to the interior surface 105 and 107 of each wall panel assembly 104 and 106 at upper and middle locations on wall panel assemblies 104 and 106.

Figure 9:
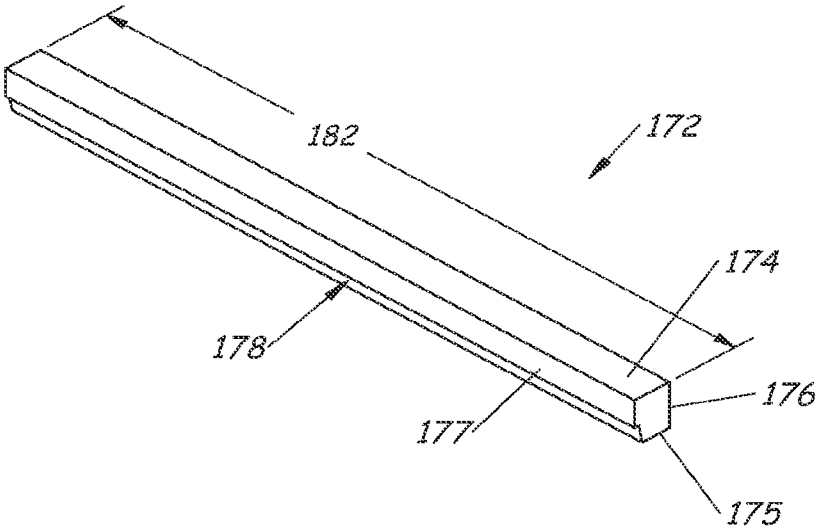
FIG. 9 is a perspective view of a cleat of the free-standing wall illustrated in FIG. 1 according another embodiment.
Figure 10:
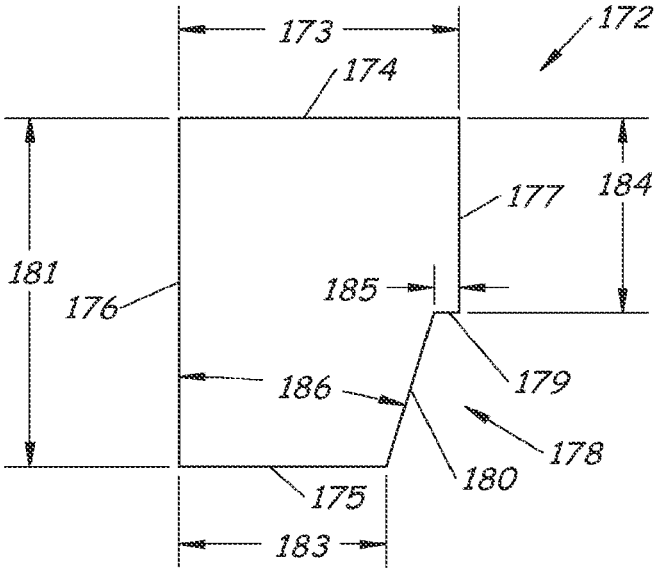
FIG. 10 is a side view of the cleat illustrated in FIG. 9.

FIG. 9 illustrates a perspective view and FIG. 10 illustrates a side view of one of the cleats or wedges 172 of the pair of wall panel assemblies 104 and 106 according to another embodiment. As illustrated in FIG. 2, though cleats 152 and 172 are coupled to interior surfaces 105 and 107 of each wall panel assembly 104 and 106, the two cleats 172 are different from the four cleats 152. In particular, the type of cleat 172 illustrated in FIGS. 9 and 10 is located on the interior surfaces 105 and 107 of each wall panel assembly 104 and 106 at two lower locations. In the lower location, two cleats 172 are attached to interior surfaces 105 and 107 and are spaced apart from each other.

With reference to FIGS. 9 and 10, cleat 172 includes a top surface 174, a bottom surface 175, a protruding surface 176 and a mounting surface 177. While top surface 174 spans an entire width 173 of cleat 172 and is substantially parallel with bottom surface 175 and protruding surface 176 spans an entire height 181 of cleat 172 and is substantially parallel with mounting surface 177, cleat 172 does not form an elongated rectangular bar of length 182. Rather, elongated cleat 172 has a length 162 that includes a shoulder 178 that intersects with bottom surface 175 and intersects with mounting surface 177. In this way, bottom surface 175 includes a width that is less than the entire width 173 of cleat 172 and mounting surface 177 includes a height 184 that is less than the entire height 181 of cleat 172. In one embodiment and as illustrated in FIGS. 9 and 10, a width 183 of bottom surface 175 is approximately 81.25% of the entire width 173 of cleat 172. In other words, if the width 173 of cleat 172 is approximately 1 inch, then the width 173 of bottom surface 175 is approximately 13/16 of an inch. In one embodiment and as illustrated in FIGS. 9 and 10, a height 184 of mounting surface 177 is approximately 75% of the entire height 181 of cleat 172. In other words, if the height 181 of cleat 172 is approximately 1.25 inches, then the height 184 of mounting surface 177 is approximately a ½ of an inch.

Shoulder 178 includes an upper surface 179 and an angled surface 180. Upper surface 179 intersects with mounting surface 177 and is substantially parallel with top surface 174. In one embodiment and as illustrated in FIGS. 9 and 10, a width 185 of upper surface 179 is approximately 6.25% of the entire width 173 of cleat 172. In other words, if the width 173 of cleat 172 is approximately 1 inch, then the width 185 of upper surface 179 is approximately 1/16 of an inch. In addition, width 185 of upper surface 179 is less than width 165 of upper surface 159. Angled surface 180 intersects with bottom surface 175 and is oriented at an acute angle 181 from protruding surface 176 and mounting surface 177. In particular, angled surface 180 is oriented at approximately 14 degrees from protruding surface 176 and mounting surface 177. As illustrated in FIG. 2, the mounting surface 177 of each cleat 172 is attached to the interior surfaces 105 and 107 of each wall panel assembly 104 and 106 at lower locations on wall panel assemblies 104 and 106.

With reference to FIG. 2, shoulders 158 of the two cleats 152, which are attached to interior surfaces 105 and 107 of wall panel assemblies 104 and 106 in the upper location, are configured to engage with edges 142 of angle bars 131 and 132. The two cleats 152 in the upper location are spaced apart from each other so that a front side 118 and a back side 120 of mid channel 136 can fit between the two cleats 152. Furthermore, shoulders 158 of the two cleats 152, which are attached to interior surfaces 105 and 107 of wall panel assemblies 104 and 106 in the middle location, are configured to engage with edges 142 of angles bars 133 and 134. The two cleats 152 in the middle location are spaced apart from each other so that a front side 118 and a back side 120 of mid channel 136 can fit between the two cleats 152. Still further, shoulders 178 of the two cleats 172, which are attached to interior surfaces 105 and 107 of wall panel assemblies 104 and 106 in the lower location, are configured to engage with edges 144 of bottom channel 120. The two cleats 172 in the lower location are spaced apart from each other so that a front side 118 and a back side 120 of mid channel 136 can fit between the two cleats 172. Upon engaging cleats 152 with edges 142 of angle bars 131 and 132 and with edges 142 of angle bars 133 and 134 and engaging cleats 172 with edges 144 of bottom channel 120, a bottom surface of each panel or wall section 109 and 111 is placed in contact with a top surface of bottom plate 123.

After wall panel assembly 104 and wall panel assembly 106 are coupled to internal frame 102 as described above, top plate 108 is secured to a top surface of top channel 121 of internal frame 102. As illustrated in FIGS. 1 and 2, top plate 108 includes apertures for receiving fasteners for securing this connection. Not only does top plate 108 finish free-standing wall unit 100, but top plate 108 acts as the component that secures the entire free-standing wall unit 100 together. Upon securing top plate 108 to top channel 121, a top surface of each panel or wall section 109 and 111 is placed in contact with a bottom surface of top plate 108.

As illustrated in FIG. 2, top plate 108 includes a width or thickness 187, panel 109 of wall panel assembly 104 includes a width or thickness 188, panel 111 of wall panel assembly 106 includes a width or thickness 189, top channel 121 and bottom channel 122 as well as end channels 124 and 126 and mid channel 136 each include a width or thickness 190 and base plate 123 includes a width 191. Width 190 of channels 121, 122, 124, 126 and 136 define a thickness of internal frame 102. Width 187 of top plate 108 is greater than the width 190 of each channel 121, 122, 124, 126 and 136 and greater than the width 191 of base plate 123.

More particularly, the combined width 188 of panel 109, width 189 of panel 111 and width 190 of each channel 121, 124, 126 or 146 is substantially similar to width 191 of base plate 123, while width 187 of top plate 108 is greater than this combined width. Therefore, top plate 108 includes enough bottom surface area to hold wall panels 109 and 111 against base plate 123 to secure the pair of wall panel assemblies 104 and 106 to internal frame 102. In this way, top plate 108 ensure that cleats 152 and 172 will not disengage from edges 142 of angle bars 131, 132, 133 and 134 or edges 144 of bottom channel 122. For example, and as illustrated in FIG. 2, width 187 of top plate can be 5.5 inches, width 188 of panel 109 and width 189 of panel 111 can be ¾ of an inch, width 190 of channels 121, 122, 124, 126 and 136 can be 3.5 inches and width 191 of base plate 123 can be 5 inches.

Figure 11:
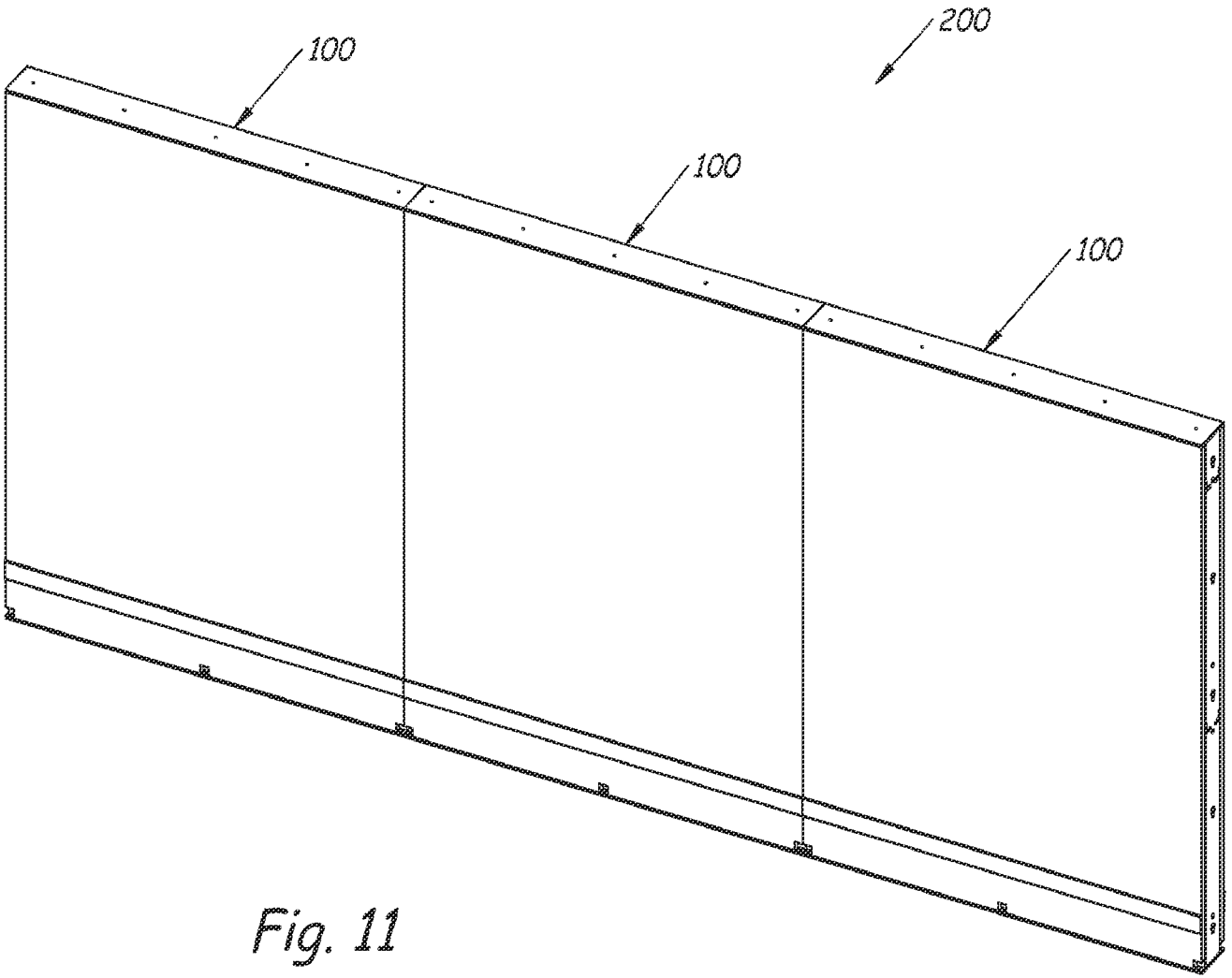
FIG. 11 is a perspective view of a plurality of the free-standing walls illustrated in FIG. 1 as coupled together to form a longer free-standing partition.

FIG. 11 illustrates a perspective view of a plurality of free-standing walls 100 illustrated as coupled together to form a longer free-standing partition 200. Utilizing holes 140 in end channels 124 and 126, walls 100 are connected together end-to-end using fasteners that are received by holes 140. Utilizing holes in base plates 123, free-standing walls 100 are anchored to a floor of work or retail space. Although FIG. 11 illustrates free-standing partition 200 as consisting of three free-standing walls 100 that are coupled end-to-end and anchored to a floor, any number of free-standing walls 100 can be coupled together to form a free-standing partition 200 of varying length. In this way, free-standing walls 100 are modular and can be easily put together or taken apart to provide varying configurations of partitions as well as providing a partition 200 that includes a single free-standing wall 100.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A free-standing wall comprising:

a substantially horizontal base frame member;

a substantially horizontal top frame member;

a pair of substantially vertical end frame members coupling ends of the substantially horizontal base frame member to ends of the substantially horizontal top frame member;

at least first and second angle bars extending between the pair of substantially vertical frame members, the first and second angle bars each having a top edge, the first and second angle bars each being L-shaped, the first angle bar being spaced from the second angle bar, the first angle bar and the second angle bar being positioned at the same height;

first and second wall sections, the first and second wall sections each having an inner facing surface and a plurality of wedges attached to the inner facing surface, wherein the plurality of wedges of the first and second wall sections include an engaging portion engaging the corresponding first and second angle bars; and a top plate coupled to a top of the substantially horizontal top frame member and having a width that is greater than the widths of each of the substantially horizontal frame members and the substantially vertical frame members, the top plate being in direct contact with a top portion of each of the first and second wall sections to secure the engaging portion of the plurality of wedges to the corresponding first and second angle bars and prevent the engaging portion of the plurality of wedges from disengaging from the corresponding first and second angle bars.

2. The free-standing wall of claim 1, wherein:

the first angle bar and the second angle bar each include an outer peripheral surface surrounding an interior of the corresponding angle bar, and the plurality of wedges are configured such that no portion of any of the plurality of wedges extends into the interior of the corresponding first and second angle bars.

3. The free-standing wall of claim 1, wherein:

each of the first angle bar and the second angle bar include a vertical leg and a horizontal leg extending from a lowermost portion of the vertical leg, and each of the plurality of wedges engages an uppermost portion of the vertical leg of the corresponding first and second angle bars.

4. The free-standing wall of claim 1, further comprising a substantially vertical middle frame member having first and second openings extending through the substantially vertical middle frame member; and, the first angle bar extends through the first opening so that a first portion of the first angle bar extends outwardly from a left most side of the substantially vertical middle frame member and a second portion of the first angle bar extends outwardly from a right most side of the substantially vertical middle frame member and the second angle bar extends through the second opening so that a first portion of the second angle bar extends outwardly from the left most side of the substantially vertical middle frame member and a second portion of the second angle bar extends outwardly from the right most side of the substantially vertical middle frame member.

5. The free-standing wall of claim 4, further comprising a base plate coupled to a bottom surface of the substantially horizontal base frame member and having a width that is greater than a width of the substantially horizontal base frame member and less than the width of the top plate.

6. The free-standing wall of claim 5, wherein each of the substantially horizontal base frame member, the substantially horizontal top frame member and the pair of substantially vertical end frame members have the same width.

7. The free-standing wall of claim 6, wherein the top plate secures a bottom of each wall section to the base plate such that the bottom of each wall section is in direct contact with the base plate.

8. A free-standing wall comprising:

a substantially horizontal base frame member;

a substantially horizontal top frame member;

a pair of substantially vertical end frame members coupling ends of the substantially horizontal base frame member to ends of the substantially horizontal top frame member;

first and second wall sections, the first and second wall sections each having an inner facing surface and at least one wedge attached to the inner facing surface, the at least one wedge attached to the inner facing surface of the first wall section includes a first wedge having an outer surface, a top surface, a bottom surface and an inner surface, the outer surface is attached to the first wall section and the inner surface is removed from the first wall section and extends from the top surface to the bottom surface, a lowermost portion of the inner surface is positioned a first distance from the first wall section and an uppermost portion of the inner surface is positioned a second distance from the first wall section, the second distance is greater than the first distance;

at least first and second interior wall section supports extending between the pair of substantially vertical frame members, the first interior wall section support and the second interior wall section support each being L-shaped and having an outer peripheral surface surrounding an interior of the corresponding interior wall section support, the first interior wall section support being spaced from said second interior wall section support, the at least one wedge being configured to mate with the outer peripheral surface of a corresponding interior wall section support such that no portion of the at least one wedge extends into the interior of the corresponding interior wall section support; and, a top plate coupled to a top of the substantially horizontal top frame member, the top plate is adapted to secure the at least one wedge of the first wall section and the at least one wedge of the second wall section to the corresponding interior wall section support.

9. The free-standing wall of claim 8, wherein:

the outer peripheral surface of each of the first and second interior wall section supports is free of openings.

10. The free-standing wall of claim 8, wherein:

the outer peripheral surface of each of the first and second interior wall section supports is continuous and uninterrupted.

11. The free-standing wall of claim 8, wherein:

a bottom surface of the top plate is in direct contact with an uppermost surface of each of the first and second wall sections.

12. The free-standing wall of claim 8, further comprising a substantially vertical middle frame member having first and second openings extending through the substantially vertical middle frame member; and, the first interior wall section support extends through the first opening so that a first portion of the first interior wall section support is disposed on one side of the substantially vertical middle frame member and a second portion of the first interior wall section support is disposed on an opposite side of the substantially vertical middle frame member and the second interior wall section support extends through the second opening so that a first portion of the second interior wall section support is disposed on the one side of the substantially vertical middle frame member and a second portion of the second interior wall section support is disposed on the opposite side of the substantially vertical middle frame member.

13. The free-standing wall of claim 8, wherein the at least one wedge attached to the inner facing surface of first wall section and the at least one wedge attached to the inner facing surface of the second wall section each have a height, a depth and a width, and the width is more than a sum of the depth and the height.

14. A free-standing wall comprising:

a substantially horizontal base frame member;

a substantially horizontal top frame member;

a pair of substantially vertical end frame members coupling ends of the substantially horizontal base frame member to ends of the substantially horizontal top frame member;

at least first and second angle bars extending between the pair of substantially vertical frame members, the first angle bar and the second angle bar each consisting of a substantially vertical leg and a substantially horizontal leg, the substantially horizontal leg extending from a lower end of the substantially vertical leg, the first angle bar being a piece separate from the second angle bar;

first and second wall sections, the first and second wall sections each having an inner facing surface and at least one wedge attached to the inner facing surface, the at least one wedge being configured to mate with a corresponding angle bar; and a top plate coupled to a top of the substantially horizontal top frame member, the top plate being in direct contact with a top portion of each of the first and second wall sections to secure the at least one wedge of the first wall section and the at least one wedge of the second wall section to the corresponding angle bar and prevent the at least one wedge of the first wall section and the at least one wedge of the second wall section from disengaging from the corresponding angle bar.

15. The free-standing wall of claim 14, wherein the at least one wedge attached to the inner facing surface of first wall section and the at least one wedge attached to the inner facing surface of the second wall section each have a height, a depth and a width, and the width is more than a sum of the depth and the height.

16. The free-standing wall of claim 14, wherein:

each of the first angle bar and the second angle bar have an outer peripheral surface surrounding an interior of the corresponding angle bar, the outer peripheral surface of each of the first angle bar and the second angle bar is free of openings.

17. The free-standing wall of claim 14, wherein:

each of the first angle bar and the second angle bar have an outer peripheral surface surrounding an interior of the corresponding angle bar, the outer peripheral surface of each of the first angle bar and the second angle bar is continuous and uninterrupted.

18. The free-standing wall of claim 14, wherein:

the substantially vertical leg extends parallel to the inner facing surface and the substantially horizontal leg extends perpendicular to the inner facing surface.

19. The free-standing wall of claim 18, wherein:

the second angle bar is horizontally aligned with the first angle bar.

* * * * *